US008581129B2

(12) United States Patent
Kennedy

(10) Patent No.: US 8,581,129 B2
(45) Date of Patent: Nov. 12, 2013

(54) ELECTRICAL CONTACTOR ARRANGEMENT FOR A PIVOT LEVER ASSEMBLY

(75) Inventor: Gregg L. Kennedy, Cleveland, OK (US)

(73) Assignee: Air Power Systems Co., Inc., Tulsa, OK (US)

( * ) Notice: Subject to any disclaimer, the term of this patent is extended or adjusted under 35 U.S.C. 154(b) by 409 days.

(21) Appl. No.: 13/093,027

(22) Filed: Apr. 25, 2011

(65) Prior Publication Data

US 2011/0308926 A1 Dec. 22, 2011

Related U.S. Application Data

(60) Provisional application No. 61/327,126, filed on Apr. 23, 2010.

(51) Int. Cl.
*H01H 3/04* (2006.01)

(52) U.S. Cl.
USPC ..... 200/335

(58) Field of Classification Search
None
See application file for complete search history.

(56) References Cited

U.S. PATENT DOCUMENTS 2,190,525 A * 2/1940 Travers ..... 200/17 R
2,230,721 A * 2/1941 Kimball ..... 200/6 B
3,993,881 A * 11/1976 Marsilio ..... 200/450
4,680,435 A * 7/1987 Sorenson ..... 200/433
5,831,232 A 11/1998 Kushnir et al.

FOREIGN PATENT DOCUMENTS

| | | | |
|---|---|---|---|
| JP | 58071948 | U | 5/1983 |
| JP | 62176934 | U | 11/1987 |
| KR | 100470435 | B1 | 1/2005 |
| WO | 2006049372 | A1 | 5/2006 |

OTHER PUBLICATIONS

PCT International Search Report, Application No. PCT/US2011/033771, Dated Dec. 27, 2011.
PCT Written Opinion of the International Searching Authority, Application No. PCT/US2011/033771, Dated Dec. 27, 2011.

* cited by examiner

*Primary Examiner* — Edwin A. Leon
(74) *Attorney, Agent, or Firm* — MacMillan, Sobanski & Todd, LLC

(57) ABSTRACT

A pivot lever assembly includes an electrical contactor arrangement that provides electrical continuity from a source of electrical power through an electrical control switch provided on a movable portion of the pivot lever assembly to an electrically controlled accessory. The pivot lever assembly includes a base. A first electrical contactor is provided on the base. The pivot lever assembly also includes a rocker that is supported for pivoting movement relative to the base. A second electrical contactor is provided on the rocker. The first electrical contactor and the second electrical contactor slidably engage one another when the rocker is pivoted relative to the base so as to maintain electrical continuity therebetween.

20 Claims, 4 Drawing Sheets

ELECTRICAL CONTACTOR ARRANGEMENT FOR A PIVOT LEVER ASSEMBLY

CROSS-REFERENCE TO RELATED APPLICATIONS

This application claims the benefit of U.S. Provisional Application No. 61/327,126, filed Apr. 23, 2010, the disclosure of which is incorporated herein by reference.

BACKGROUND OF THE INVENTION

This invention relates in general to pivot lever assemblies for controlling the operation of fluid-actuated devices. In particular, this invention relates to an improved structure for such a pivot lever assembly that includes an electrical contactor arrangement for providing electrical continuity between an electrical switch provided on the pivot lever assembly and an electrically controlled accessory provided on the fluid-actuated device.

Pivot lever assemblies are well known in the art and are used for selectively controlling the operation of a wide range of fluid-actuated (both hydraulic and/or pneumatic) devices, such as dump beds, trash compactors, snow plows, and the like. A typical pivot lever assembly includes a base that contains one or more fluid control valves adapted to be connected between a source of fluid pressure and a fluid actuated device. A control arm is supported on the base for selective pivoting movement relative thereto, typically in either a fore or an aft direction from a central position. Such movement of the control arm opens and closes the fluid valves contained within the base. The operation of such fluid valves controls the manner in which fluid pressure is supplied from the source of fluid pressure to the fluid actuated device and, therefore, allows an operator to control the operation thereof.

In some instances, the fluid actuated device may have an electrically controlled accessory provided thereon. For example, it is known to provide an electrically actuated lock for a tailgate on the dump bed of a truck. In those instances, it is desirable that an electrical control switch be provided on the control arm of the pivot lever assembly for convenient access and use by the operator. The electrical control switch is adapted to be connected between a source of electrical power and the electrically controlled accessory. To accomplish this, one or more wires or other electrical conductors are provided on the pivot lever assembly. Such wires typically extend from the base of the pivot lever assembly to the electrical control switch supported on the control arm. The wires provide electrical continuity from the source of electrical power through the electrical control switch to the electrically controlled accessory.

Although known pivot lever assemblies have functioned satisfactorily, repeated pivoting movement of the control arm relative to the base can cause repeated bending of the wires that extend from the base of the pivot lever assembly to the electrical control switch supported on the control arm. It has been found that in some instances, an excessive amount of such bending can cause premature fatigue in these wires. Thus, it would be desirable to provide an improved structure for a pivot lever assembly that provides electrical continuity from the source of electrical power through the electrical control switch to the electrically controlled accessory without repeated bending any wires.

SUMMARY OF THE INVENTION

This invention relates to an improved structure for a pivot lever assembly including an electrical contactor arrangement that provides electrical continuity from a source of electrical power through an electrical control switch provided on a movable portion of the pivot lever assembly to an electrically controlled accessory. The pivot lever assembly includes a base. A first electrical contactor is provided on the base. The pivot lever assembly also includes a rocker that is supported for pivoting movement relative to the base. A second electrical contactor is provided on the rocker. The first electrical contactor and the second electrical contactor slidably engage one another when the rocker is pivoted relative to the base so as to maintain electrical continuity therebetween.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
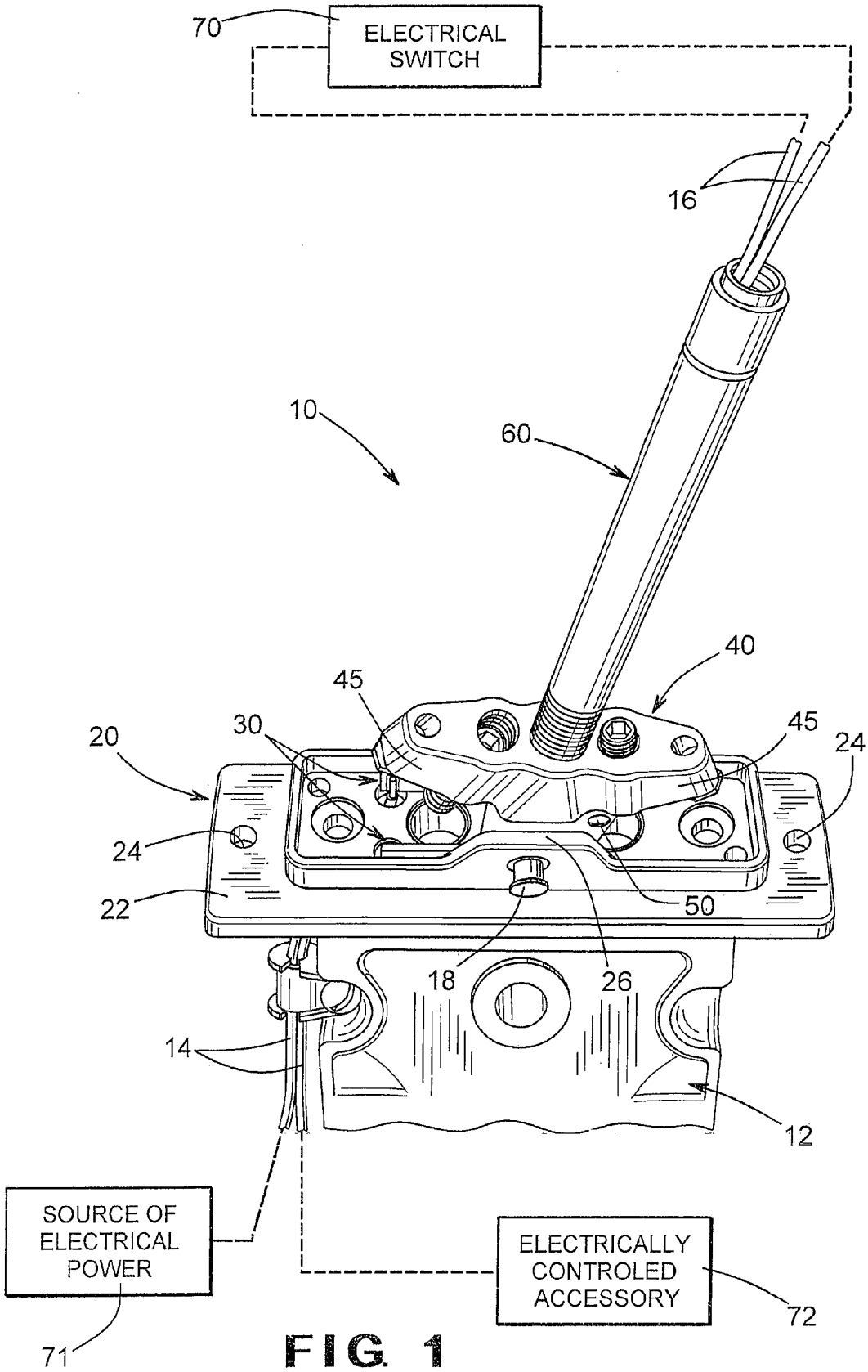
FIG. 1 is a perspective view of a first embodiment of a pivot lever assembly in accordance with this invention.

Referring now to the drawings, there is illustrated in FIG. 1 a first embodiment of a pivot lever assembly, indicated generally at 10, in accordance with this invention. The illustrated pivot lever assembly 10 can be used for selectively controlling the operation of a wide range of fluid-actuated (both hydraulic and/or pneumatic) devices, such as dump beds, trash compactors, snow plows, and the like. However, the illustrated pivot lever assembly 10 is intended merely to illustrate one environment in which this invention may be used. Thus, the scope of this invention is not intended to be limited for use with the specific structure for the pivot lever assembly 10 illustrated in FIG. 1 or with pivot lever assemblies in general. On the contrary, as will become apparent below, this invention may be used in any desired environment for the purposes described below.

The illustrated pivot lever assembly 10 is mounted on a control valve assembly, indicated generally at 12 that is conventional in the art. The control valve assembly 12 includes one or more fluid valves (hydraulic and/or pneumatic) that are adapted to be connected between a source of fluid pressure (not shown), such as a source of hydraulic or pneumatic pressure, for example, and a fluid actuated device (not shown). The pivot lever assembly 10 controls the operation of the control valve assembly 12 which, in a well known manner, controls the manner in which fluid pressure is supplied from the source of fluid pressure to the fluid actuated device and, therefore, controls the operation thereof.

As best shown in FIG. 1, the illustrated pivot lever assembly 10 includes a base 20 that is supported on the control valve assembly 12, a rocker 40 that is pivotably supported on the base 20, and a control arm 60 that is connected to the rocker 40 for pivoting movement therewith. In a manner that is well known in the art, pivoting movement of the rocker 40 relative to the base 20 operates the control valve assembly 12 by opening and closing the fluid valves contained therein. The control arm 60 extends from the rocker 40 to facilitate the pivoting movement of the rocker 40 relative to the base 20 by an operator of the pivot lever assembly 10. An electrical control switch 70 is provided on the control arm 60, typically at an end thereof that is remote from the base 20 for convenient access and use by the operator.

As described above, the electrical control switch 70 can be connected one or more electrical components. In the illustrated embodiment, the electrical control switch 70 is connected between a source of electrical power 71 and an electrically controlled accessory 72, which is typically provided on the fluid-actuated device controlled by the pivot lever assembly 10. To accomplish this, the pivot lever assembly 10 is provided with one or more wires or similar electrical conductors. The illustrated pivot lever assembly 10 include a pair of external wires 14 and a pair of internal wires 16. As will be explained in detail below, one external wire 14 extends from the source of electrical power 71 to an electrical contactor arrangement provided within the pivot lever assembly 10, while the other external wire 14 extends from such electrical contactor arrangement to the electrically controlled accessory 72. Similarly, one internal wire 16 extends from the electrical contactor arrangement provided within the pivot lever assembly 10 to the electrical switch 70, while the other internal wire 16 extends from the electrical switch 70 back to the electrical contactor arrangement. Thus, the electrical contactor arrangement provides electrical continuity between the external wires 14 and the internal wires 16 as the control arm 60 and the rocker 40 of the pivot lever assembly 10 are moved relative to the base 20.

Figure 2:
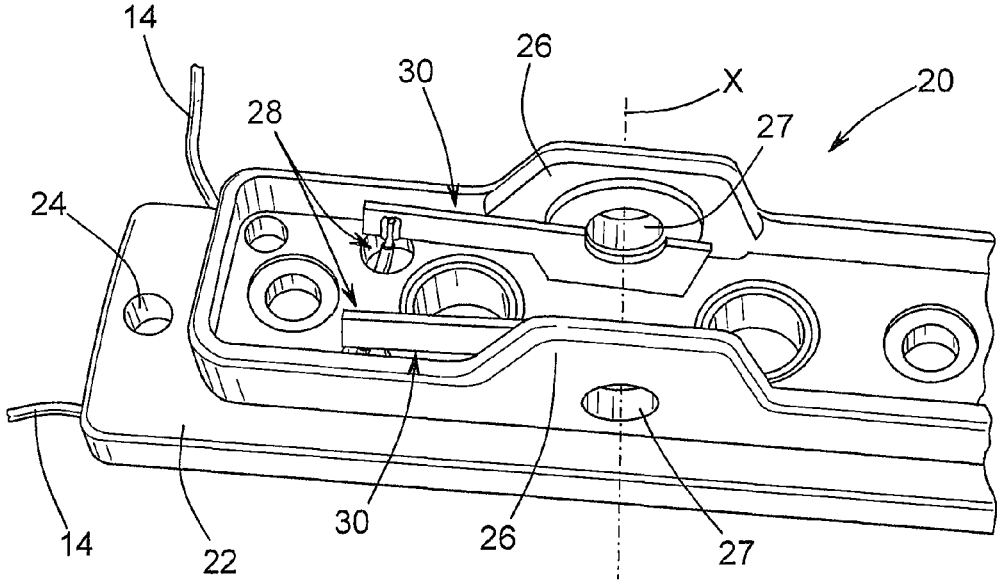
FIG. 2 is an enlarged perspective view of a base of the pivot lever assembly illustrated in FIG. 1.

The structure of the base 20 of the pivot lever assembly 40 is illustrated in detail in FIG. 2. As shown therein, the base 20 includes a plate 22 that, in the illustrated embodiment, is generally rectangular and planar in shape. However, the base 20 and the plate 22 may have any desired shape. The plate 22 is adapted to secure the pivot lever assembly 10 to the control valve assembly 12. To accomplish this, the illustrated plate 22 has a plurality of holes 24 (only one is illustrated in FIG. 2) formed therethrough. The holes 24 are provided to allow respective fasteners (not shown) to extend therethrough to secure the base 20 to the control valve assembly 12. The illustrated base 20 also includes a pair of spaced apart support walls 26 that extend upwardly away from the plate 22 away from the control valve assembly 12. The support walls 26 have respective bores 27 formed therethrough that define a pivot axis, which is indicated by the dotted line X in FIG. 2. Referring back to FIG. 1, it can be seen that the aligned bores 27 in the support walls 26 of the base 20 receive a pivot pin 18 that supports the rocker 40 on the base 20 for pivoting movement relative thereto. The manner in which the rocker 40 is supported on the base 20 for pivoting movement relative thereto will be explained further below.

Referring again to FIG. 2, the illustrated plate 22 of the base 20 has a pair of apertures 28 (only one is illustrated in FIG. 2) formed therethrough that permit the input wires 14 to respectively pass therethrough. Thus, the apertures 28 function as a pair of passageways that each extends from a bottom surface of the plate 22 to a top surface thereof.

As mentioned above, the pivot lever assembly 10 includes an electrical contactor arrangement that provides electrical continuity between the external wires 14 and the internal wires 16 as the control arm 60 and the rocker 40 of the pivot lever assembly 10 are moved relative to the base 20 during use. The electrical contactor arrangement includes one or more stationary contactors 30 that are supported on the base 20 of the pivot lever assembly 10. As best shown in FIG. 2, two of such stationary contactors 30 are respectively supported on the support walls 26 of the base 20 in the illustrated embodiment. However, the stationary contactors 30 may be provided at any desired location relative to the base 20 of the pivot lever assembly 10.

Figure 3:
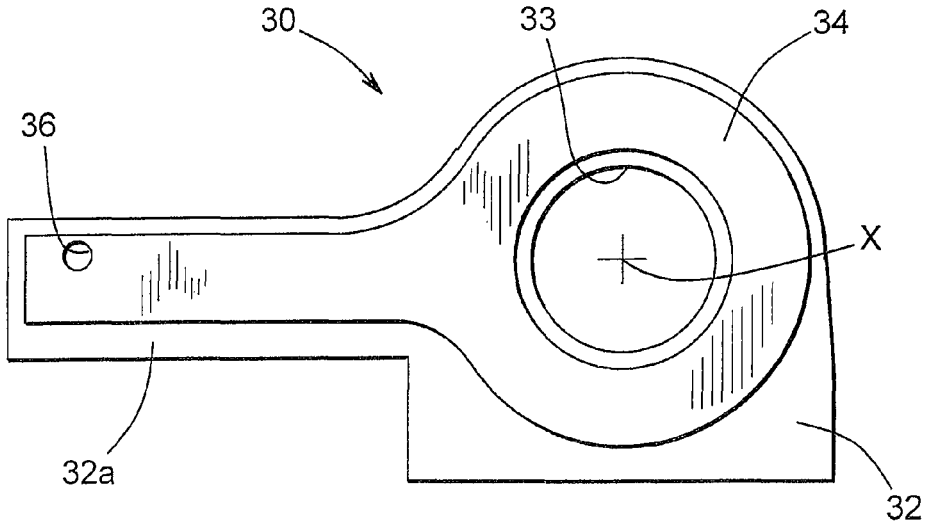
FIG. 3 is a side elevational view of a first embodiment of a stationary contactor of the base illustrated in FIG. 2.

The structure of one of the stationary contactors 30 is illustrated in detail in FIG. 3. As shown therein, the stationary contactor 30 is generally flat and planar in shape. The illustrated stationary contactor 30 has a body 32 that includes a central portion having an arm portion that extends away from the central portion. However, the body 32 of the stationary contactor 30 may be formed having any desired shape. If the pivot lever assembly 10 is provided with a plurality of stationary contactors 30 (as in the illustrated embodiment), then the bodies 32 of the stationary contactors 30 may be formed having different shapes. The body 32 of the illustrated stationary contactor 30 is preferably formed from a relative rigid, electrically non-conductive material, such as fiberglass or the like, although such is not required. In the illustrated embodiment, the central portion of the stationary contactor 30 has a relatively large opening 33 formed therethrough, while the arm portion of the stationary contactor 30 has a relatively small aperture 36 formed therethrough. The purposes for the opening 33 and the aperture 36 will be explained below.

The body 32 of the stationary contactor 30 also has a layer of an electrically conductive material 34 provided thereon. The electrically conductive layer 34 may, as illustrated, be embodied as a thin foil of a copper or copper alloy material that is adhered or otherwise secured to a surface of the body 32 of the stationary contactor 30. In the illustrated embodiment, the electrically conductive layer 34 extends throughout both the central portion and the arm portion of the body 32 of the stationary contactor 30. As clearly shown in FIG. 2, the portion of the electrically conductive layer 34 that is provided on the central portion of the body 32 of the stationary contactor 30 is generally circular in shape, while the portion of the electrically conductive layer 34 that is provided on the arm portion of the body 32 of the stationary contactor 30 is generally linear in shape. However, the electrically conductive layer 34 may be formed from any desired material and have any desired shape. If the pivot lever assembly 10 is provided with a plurality of stationary contactors 30 (as in the illustrated embodiment), then the electrically conductive layers 34 may be formed from different materials and have differing shapes.

As mentioned above, the stationary contactors 30 are respectively supported on the support walls 26 of the base 20 of the pivot lever assembly 10. When so disposed, the enlarged openings 33 of the stationary contactors 30 are aligned with the bores 27 formed through the support walls 26 of the base 20 and with the pivot axis X defined by such bores 27. The enlarged openings 33 allow the pivot pin 18 (which, as discussed above, supports the rocker 40 on the base 20 for pivoting movement relative thereto) to extend freely through the enlarged openings 33 formed through the stationary contactors 30 into engagement with the support walls 26 of the base 20 of the pivot lever assembly 10. As also mentioned above, the arm portion of each stationary contactor 30 has a relatively small aperture 36 formed therethrough. These apertures 36 are provided to facilitate the connections of the external wires 14 to the respective stationary contactors 30. As shown in FIG. 3, the aperture 36 is formed through the electrically conductive layer 34 of the stationary contactor 30. Thus, by inserting the ends of the external wires 14 through the apertures 36 and securing same together (such as by soldering or any other means), the external wires 14 are both mechanically and electrically connected to the stationary contactors 30.

Figure 4:
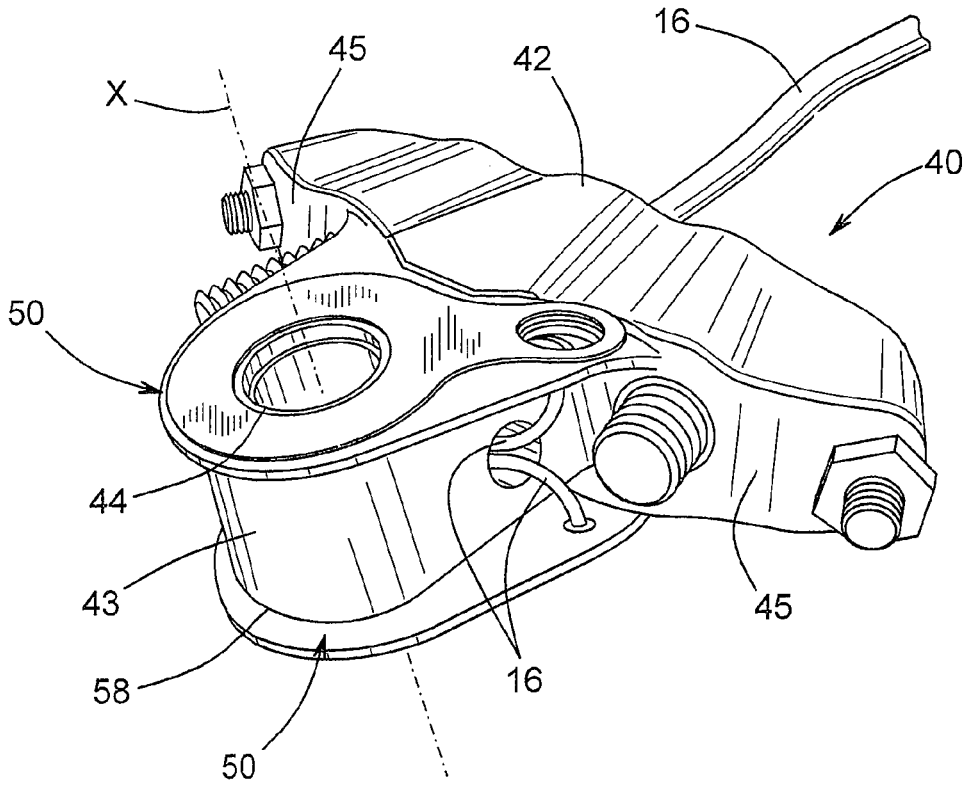
FIG. 4 is a perspective view of a rocker of the pivot lever assembly illustrated in FIG. 1.

The structure of the rocker 40 of the pivot lever assembly 10 is illustrated in detail in FIG. 4. As shown therein, the rocker 40 includes a body 42 having a hub portion 43. A bore 44 extends through the hub portion 43 of the body 42 for a purpose that will be explained below. The body 42 of the rocker 40 further includes a pair of rocker arms 45 that extend from laterally from the hub portion 43. The rocker arms 45 are conventional in the art and are provided both to operate the control valve assembly 12 when the rocker 40 is pivoted relative to the base 20 and to limit the amount by which the rocker 40 can be pivoted relative to the base 20. The control arm 60 of the pivot lever assembly 10 is secured to the rocker 40 in any conventional manner, as shown in FIG. 1. As mentioned above, the control arm 60 extends from the rocker 40 to facilitate the pivoting movement of the rocker 40 relative to the base 20 by an operator.

The electrical contactor arrangement further includes one or more movable contactors 50 that are supported on the rocker 40 of the pivot lever assembly 10 for pivoting movement therewith. In the illustrated embodiment, two of such movable contactors 50 are respectively supported on the opposite sides of the hub portion 43, as best shown in FIG. 4. However, the movable contactors 50 may be provided at any desired location relative to the rocker 40 of the pivot lever assembly 10.

Figure 5:
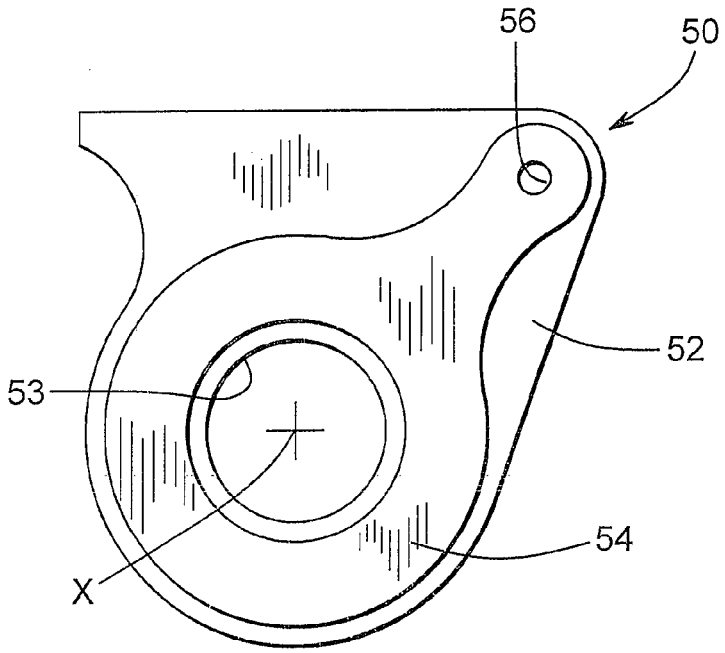
FIG. 5 is a side elevational view of a first embodiment of a movable contactor of the rocker illustrated in FIG. 4.

The structure of one of the movable contactors 50 is illustrated in detail in FIG. 5. As shown therein, the movable contactor 50 is generally flat and planar in shape. The illustrated movable contactor 50 has a body 52 that includes a central portion having an arm portion that extends away from the central portion. However, the body 52 of the movable contactor 50 may be formed having any desired shape. If the pivot lever assembly 10 is provided with a plurality of movable contactors 50 (as in the illustrated embodiment), then the bodies 52 of the movable contactors 50 may be formed having different shapes. The body 52 of the movable contactor 50 is preferably formed from a relative rigid, electrically non-conductive material, such as fiberglass or the like, although such is not required. In the illustrated embodiment, the central portion of the movable contactor 50 has a relatively large opening 53 formed therethrough, while the arm portion of the movable contactor 50 has a relatively small aperture 56 formed therethrough. The purposes for the opening 53 and the aperture 56 will be explained below.

The body 52 of the movable contactor 50 has a layer of an electrically conductive material 54 provided thereon. The electrically conductive layer 54 may, as illustrated, be embodied as a thin foil of a copper or copper alloy material that is adhered or otherwise secured to a surface of the body 52 of the movable contactor 50. In the illustrated embodiment, the electrically conductive layer 54 extends throughout both the central portion and the arm portion of the body 52 of the movable contactor 50. As clearly shown in FIG. 5, the portion of the electrically conductive layer 54 that is provided on the central portion of the body 52 of the movable contactor 50 is generally circular in shape, while the portion of the electrically conductive layer 54 that is provided on the arm portion of the body 52 of the movable contactor 50 is generally linear in shape. However, the electrically conductive layer 54 may be formed from any desired material and have any desired shape. If the pivot lever assembly 10 is provided with a plurality of movable contactors 50 (as in the illustrated embodiment), then the electrically conductive layers 54 may be formed from different materials and have differing shapes.

As mentioned above, the movable contactors 50 are respectively supported on the opposite sides of the rocker 40 of the pivot lever assembly 10. When so disposed, the enlarged openings 53 of the movable contactors 50 are aligned with the hub portion 43 of the body 42 of the rocker 40 and, thus, with the pivot axis X. The enlarged openings 53 allow the pivot pin 18 (which, as discussed above, supports the rocker 40 on the base 20 for pivoting movement relative thereto) to extend freely through the enlarged openings 53 of the movable contactors 50 into engagement with the support walls 26 of the base 20 of the pivot lever assembly 10. As also mentioned above, the arm portion of each movable contactor 50 has a relatively small aperture 56 formed therethrough. These apertures 56 are provided to facilitate the connections of the internal wires 16 respectively to the movable contactors 50. As shown in FIG. 5, the aperture 56 is formed through the electrically conductive layer 54 of the movable contactor 50. Thus, by inserting the ends of the internal wires 16 through the apertures 56 and securing same together (such as by soldering or any other means), the internal wires 16 are both mechanically and electrically connected to the movable contactors 50.

If desired, a biasing member 58 may be provided between the hub portion 43 of the body 42 of the rocker 40 and each of the movable contactors 50 (only one of such biasing members 58 is shown in FIG. 4). The biasing members may, for example, be embodied as conventional wave or similarly curved disc springs. The biasing members urge the movable contactors 50 outwardly away from the hub portion 43 of the body 42 of the rocker 40 for a purpose that will be explained below.

Referring back to FIG. 1, the rocker 40 is pivotably supported on the base 20 by initially aligning the bore 44 formed through the hub portion 43 of the rocker 40 (including the enlarged openings 33 of the stationary contactors 30) with the bores 27 respectively formed through the support walls 26 of the base 20 (including the enlarged openings 53 of the movable contactors 50). Following such alignment, the pivot pin 18 is inserted through the bores 27 and 44 and the openings 33 and 53. As a result, the rocker 40 is supported for pivoting movement relative to the base 20. In a manner that is well known in the art, the pivoting movement of the rocker 40 relative to the base 20 opens and closes one or more of the fluid valves (not shown) contained within the control valve assembly 12. As discussed above, this operation of the control valve assembly 12 controls the manner in which fluid pressure is supplied from the source of fluid pressure to the fluid actuated device and, therefore, controls the operation thereof.

When the rocker 40 is pivotably supported on the base 20, the circle-shaped portions of the electrically conductive layers 34 provided on the stationary contactors 30 slidably engage the circle-shaped portions of the electrically conductive layers 54 provided on the movable contactors 50. As a result, electrical continuity is provided from the external wires 14 through the electrical contactor arrangement to the internal wires 16. Such electrical continuity is maintained as the rocker 40 is pivoted and positioned relative to the base 20 during operation of the pivot lever assembly 10 because the circle-shaped portions of the electrically conductive layers 34 and 54 cannot be rotated or otherwise moved out of engagement with one another. As discussed above, the biasing members urge the movable contactors 50 outwardly away from the hub portion 43 of the body 42 of the rocker 40 into positive engagement with the stationary contactors 30 to maintain such electrical continuity during such relative movement. As a result, no undesirable bending of the external and internal wires 14 and 16 of the pivot lever assembly 10 occurs during operation.

Figure 6:
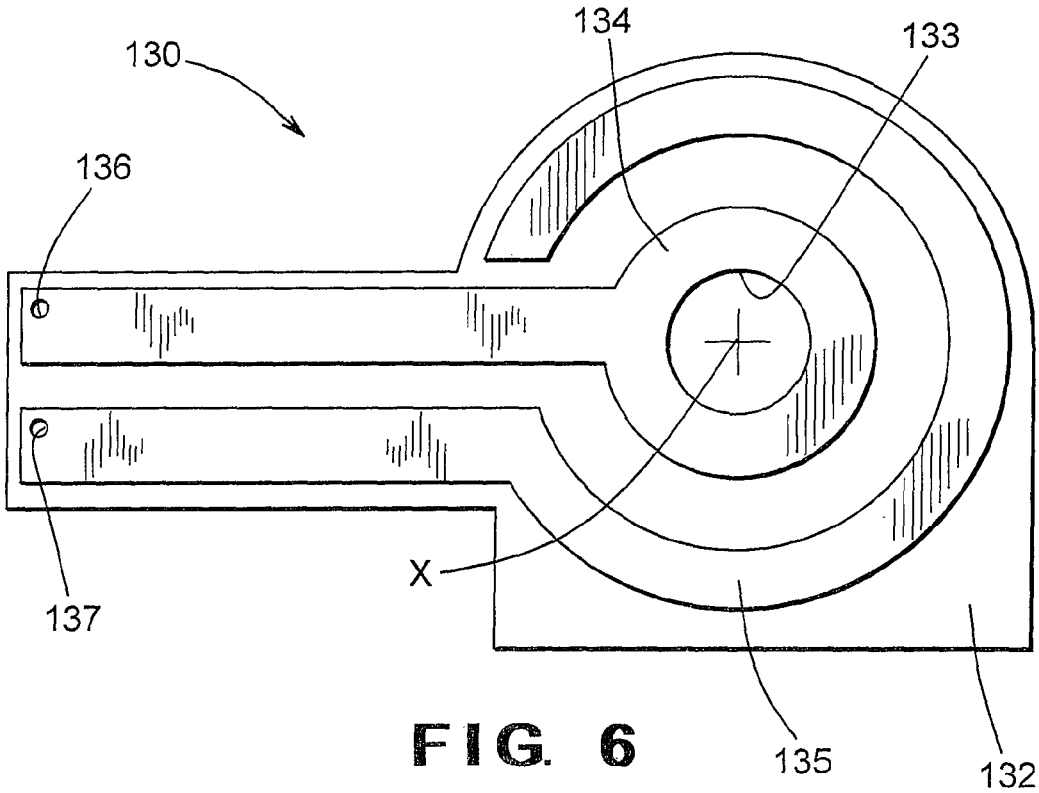
FIG. 6 is a side elevational view of a second embodiment of a stationary contactor of the base in accordance with this invention.
Figure 7:
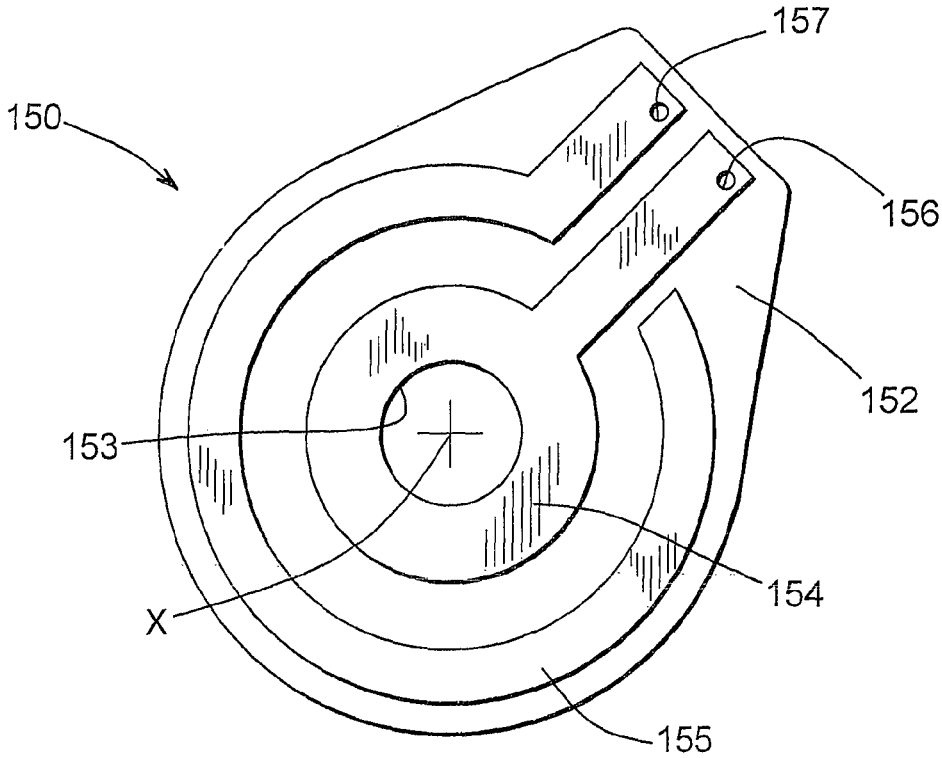
FIG. 7 is a side elevational view of a second embodiment of a movable contactor of the base in accordance with this invention.

FIGS. 6 and 7 respectively illustrate second embodiments of the stationary contactor 130 and the movable contactor 150 that can be used in the pivot lever assembly 10 described above in lieu of the stationary contactor 30 and the movable contactor 50. As will become apparent below, the second embodiments of the stationary contactor 130 and the movable contactor 150 can be used to permit two or more electrical switches (not shown) to be provided on the control arm 60 of the pivot lever assembly 10. Such plural electrical switches can be used to control the operation of respective electrical accessories.

The illustrated stationary contactor 130 has a body 132 that includes a central portion having an arm portion that extends away from the central portion. However, the body 132 of the stationary contactor 130 may be formed having any desired shape. If the pivot lever assembly 10 is provided with a plurality of stationary contactors 130 (as in the illustrated embodiment), then the bodies 132 of the stationary contactors 130 may be formed having different shapes. The body 132 of the illustrated stationary contactor 130 is preferably formed from a relative rigid, electrically non-conductive material, such as fiberglass or the like, although such is not required. In the illustrated embodiment, the central portion of the stationary contactor 130 has a relatively large opening 133 formed therethrough, while the arm portion of the stationary contactor 30 has a pair of relatively small apertures 136 and 137 formed therethrough for a purpose that will be explained below.

The body 132 of the stationary contactor 130 has a plurality of separate layers (two in the illustrated embodiment) of an electrically conductive material 134 and 135 provided thereon. The electrically conductive layers 134 and 135 may, as illustrated, be embodied as respective thin foils of a copper or copper alloy material that are adhered or otherwise secured to a surface of the body 132 of the stationary contactor 130. In the illustrated embodiment, each of the electrically conductive layers 134 and 135 extends throughout both the central portion and the arm portion of the body 132 of the stationary contactor 130. As clearly shown in FIG. 6, the portions of the electrically conductive layers 134 and 135 that are provided on the central portion of the body 132 of the stationary contactor 130 are generally circular in shape and concentric with one another, while the portions of the electrically conductive layers 134 and 135 that are provided on the arm portion of the body 132 of the stationary contactor 130 are generally linear in shape. However, the electrically conductive layers 134 and 135 may be formed from any desired material and have any desired shape. If the pivot lever assembly 10 is provided with a plurality of stationary contactors 130 (as in the illustrated embodiment), then the electrically conductive layers 134 and 135 may be formed from different materials and have differing shapes. The apertures 136 and 137 are respectively formed through each of the electrically conductive layers 134 and 135 of the stationary contactor 30. Thus, respective external wires (not shown) can be both mechanically and electrically connected to the stationary contactor 130 in the manner described above.

The illustrated movable contactor 150 has a body 152 that includes a central portion having an arm portion that extends away from the central portion. However, the body 152 of the movable contactor 150 may be formed having any desired shape. If the pivot lever assembly 10 is provided with a plurality of movable contactors 150 (as in the illustrated embodiment), then the bodies 152 of the movable contactors 150 may be formed having different shapes. The body 152 of the movable contactor 150 is preferably formed from a relative rigid, electrically non-conductive material, such as fiberglass or the like, although such is not required. In the illustrated embodiment, the central portion of the movable contactor 150 has a relatively large opening 153 formed therethrough, while the arm portion of the movable contactor 150 has a pair of relatively small apertures 156 and 157 formed therethrough for a purpose that will be explained below.

The body 152 of the movable contactor 150 has a plurality of layers (two in the illustrated embodiment) of an electrically conductive material 154 and 155 provided thereon. The electrically conductive layers 154 and 155 may, as illustrated, be embodied as respective thin foils of a copper or copper alloy material that are adhered or otherwise secured to a surface of the body 152 of the movable contactor 150. In the illustrated embodiment, each of the electrically conductive layers 154 and 155 extends throughout both the central portion and the arm portion of the body 152 of the movable contactor 150. As clearly shown in FIG. 7, the portions of the electrically conductive layers 154 and 155 that are provided on the central portion of the body 152 of the movable contactor 150 are generally circular in shape and concentric with one another, while the portions of the electrically conductive layers 154 and 155 that are provided on the arm portion of the body 152 of the movable contactor 150 are generally linear in shape. However, the electrically conductive layers 154 and 155 may be formed from any desired material and have any desired shape. If the pivot lever assembly 10 is provided with a plurality of movable contactors 150 (as in the illustrated embodiment), then the electrically conductive layers 154 may be formed from different materials and have differing shapes. The apertures 156 and 157 are formed through each of the electrically conductive layers 154 and 155 of the movable contactor 50. Thus, respective internal wires (not shown) can be both mechanically and electrically connected to the movable contactor 50 in the manner described above.

When the rocker 40 is pivotably supported on the base 20, the circle-shaped portions of the electrically conductive layers 134 and 135 provided on the stationary contactor 130 respectively slidably engage the circle-shaped portions of the electrically conductive layers 154 and 155 provided on the movable contactor 150. As a result, electrical continuity is provided from the external wires 14 through the electrical contactor arrangement to the internal wires 16. Such electrical continuity is maintained as the rocker 40 is pivoted and positioned relative to the base 20 during operation of the pivot lever assembly 10 because the circle-shaped portions of the electrically conductive layers 134, 135 and 154, 155 cannot be rotated or otherwise moved out of engagement with one another. As discussed above, the biasing members urge the movable contactors 150 outwardly away from the hub portion 43 of the body 42 of the rocker 40 into positive engagement with the stationary contactors 130 to maintain such electrical continuity through our relative movement. As a result, undesirable excessive bending of the external and internal wires 14 and 16 of the pivot lever assembly 10 is prevented.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A pivot lever assembly comprising:

a control valve assembly;

a base that is supported relative to the control valve assembly;

a first electrical contactor provided on the base;

a rocker that is supported for movement relative to the base;

an electrical switch supported for movement with the rocker; and a second electrical contactor provided on the rocker and electrically connected to the electrical switch, wherein the first electrical contactor and the second electrical contactor engage one another when the rocker is moved relative to the base so as to maintain electrical continuity therebetween.

2. The pivot lever assembly defined in claim 1 wherein the first electrical contactor and the second electrical contactor slidably engage another when the rocker is moved relative to the base.

3. The pivot lever assembly defined in claim 1 wherein the first electrical contactor includes a first body formed from electrically non-conductive material having a first layer of an electrically conductive material provided thereon and the second electrical contactor includes a second body formed from electrically non-conductive material having a second layer of an electrically conductive material provided thereon, wherein the first and second layers of the electrically conductive material engage one another when the rocker is pivoted relative to the base.

4. The pivot lever assembly defined in claim 3 wherein the first and second layers of the electrically conductive material are generally circular in shape.

5. The pivot lever assembly defined in claim 1 further including a biasing member that is disposed between the rocker and the second electrical contactor and urges the second electrical contactor into engagement with the first electrical contactor.

6. The pivot lever assembly defined in claim 1 wherein the base, the first electrical contactor, the rocker, and the second electrical contactor have respective bores formed therethrough, and wherein a pivot pin extends through each of the bores to support the rocker for movement relative to the base.

7. The pivot lever assembly defined in claim 1 wherein a plurality of first electrical contactors is provided on the base, and wherein a plurality of second electrical contactors is provided on the rocker and electrically connected to the electrical switch, wherein the plurality of first electrical contactors and the plurality of second electrical contactor respective engage one another when the rocker is moved relative to the base so as to respectively maintain electrical continuity therebetween.

8. The pivot lever assembly defined in claim 7 further including a biasing member that is disposed between the rocker and each of the plurality of the second electrical contactor and urges the plurality of the second electrical contactors into respective engagement with the plurality of the first electrical contactors.

9. The pivot lever assembly defined in claim 1 wherein the first electrical contactor includes a body formed from electrically non-conductive material having first and second layers of an electrically conductive material provided thereon and the second electrical contactor includes a body formed from electrically non-conductive material having first second layers of an electrically conductive material provided thereon, wherein the first and second layers of the first electrical contactor respectively engage first and second layers of the second electrical contactor when the rocker is pivoted relative to the base.

10. The pivot lever assembly defined in claim 9 wherein the first and second layers of the first electrical contactor are generally circular in shape, and wherein the first and second layers of the second electrical contactor are generally circular in shape.

11. A pivot lever assembly that is adapted to control the operation of both a fluid-actuated device and an electrical component, the pivot lever assembly comprising:

a control valve assembly that is adapted to control the operation of a fluid-actuated device;

a base that is supported relative to the control valve assembly;

a first electrical contactor provided on the base and adapted to be electrically connected to an electrical component;

a rocker that is supported for movement relative to the base such that movement of the rocker causes operation of the control valve assembly;

an electrical switch supported for movement with the rocker; and a second electrical contactor provided on the rocker and electrically connected to the electrical switch, wherein the first electrical contactor and the second electrical contactor engage one another when the rocker is moved relative to the base so as to maintain electrical continuity therebetween.

12. The pivot lever assembly defined in claim 11 wherein the first electrical contactor and the second electrical contactor slidably engage another when the rocker is moved relative to the base.

13. The pivot lever assembly defined in claim 11 wherein the first electrical contactor includes a first body formed from electrically non-conductive material having a first layer of an electrically conductive material provided thereon and the second electrical contactor includes a second body formed from electrically non-conductive material having a second layer of an electrically conductive material provided thereon, wherein the first and second layers of the electrically conductive material engage one another when the rocker is pivoted relative to the base.

14. The pivot lever assembly defined in claim 13 wherein the first and second layers of the electrically conductive material are generally circular in shape.

15. The pivot lever assembly defined in claim 11 further including a biasing member that is disposed between the rocker and the second electrical contactor and urges the second electrical contactor into engagement with the first electrical contactor.

16. The pivot lever assembly defined in claim 11 wherein the base, the first electrical contactor, the rocker, and the second electrical contactor have respective bores formed therethrough, and wherein a pivot pin extends through each of the bores to support the rocker for movement relative to the base.

17. The pivot lever assembly defined in claim 11 wherein a plurality of first electrical contactors is provided on the base that are adapted to be electrically connected to respective to electrical components, and wherein a plurality of second electrical contactors is provided on the rocker and electrically connected to the electrical switch, wherein the plurality of first electrical contactors and the plurality of second electrical contactor respective engage one another when the rocker is moved relative to the base so as to respectively maintain electrical continuity therebetween.

18. The pivot lever assembly defined in claim 17 further including a biasing member that is disposed between the rocker and each of the plurality of the second electrical contactor and urges the plurality of the second electrical contactors into respective engagement with the plurality of the first electrical contactors.

19. The pivot lever assembly defined in claim 11 wherein the first electrical contactor includes a body formed from electrically non-conductive material having first and second layers of an electrically conductive material provided thereon and the second electrical contactor includes a body formed from electrically non-conductive material having first second layers of an electrically conductive material provided thereon, wherein the first and second layers of the first electrical contactor respectively engage first and second layers of the second electrical contactor when the rocker is pivoted relative to the base.

20. The pivot lever assembly defined in claim 19 wherein the first and second layers of the first electrical contactor are generally circular in shape, and wherein the first and second layers of the second electrical contactor are generally circular in shape.

* * * * *